US007124601B2

(12) United States Patent
Kim et al.

(10) Patent No.: US 7,124,601 B2
(45) Date of Patent: Oct. 24, 2006

(54) BUILT-IN TYPE OUTDOOR UNIT FOR AIR CONDITIONER

(75) Inventors: In-Gyu Kim, Jinhae-Shi (KR); Young-Ju Bae, Changwon-Shi (KR); Jae-Hyung Koo, Changwon-Shi (KR); Byung-Il Park, Changwon-Shi (KR); Kyeong-Ho Kim, Changwon-Shi (KR); Yang-Ho Kim, Changwon-shi (KR); Young-Ho Hong, Kimhae-Shi (KR); Kyeong-Wook Heo, Changwon-shi (KR); Kang-Wook Cha, Changwon-shi (KR); Si-Kyong Sung, Changwon-Shi (KR); Dong-Hyuk Lee, Jinhae-Shi (KR); Seong-Min Kang, Seoul (KR); Tae-Geun Kim, Changwon-Shi (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 10/250,789

(22) PCT Filed: Apr. 18, 2003

(86) PCT No.: PCT/KR03/00797

§ 371 (c)(1),
(2), (4) Date: Jul. 9, 2003

(87) PCT Pub. No.: WO03/088732

PCT Pub. Date: Oct. 30, 2003

(65) Prior Publication Data

US 2004/0255614 A1 Dec. 23, 2004

(30) Foreign Application Priority Data

Feb. 26, 2003 (KR) ..... 10-2003-0012097

(51) Int. Cl.
*F25D 17/06* (2006.01)

(52) U.S. Cl. ..... 62/428; 62/508

(58) Field of Classification Search ..... 62/259.1, 62/404, 507, 298, 428, 506, 508, 180, 181, 62/183, 186, 263, 305; 454/233, 313, 316, 454/241, 243, 234, 277, 325; 126/85 B
See application file for complete search history.

(56) References Cited

U.S. PATENT DOCUMENTS 2,293,065 A 8/1942 Kiczales ..... 98/110

(Continued)

FOREIGN PATENT DOCUMENTS

JP 54-18043 2/1979
JP 03-213928 9/1991

(Continued)

*Primary Examiner*—Mohammad M. Ali
(74) *Attorney, Agent, or Firm*—Fleshner & Kim, LLP

(57) ABSTRACT

A built-in type compressor/condenser unit for an air conditioner is provided which prevents re-suction of discharged air. The built-in type compressor/condenser unit includes a louver frame which is installed on an inner portion of an outer wall of a building, and which divided into a suction area and a discharge area each having a plurality of louver blades. A compressor/condenser casing is installed in contact with the louver frame, having its surface facing the suction area and the discharge area of the louver frame opened and the other surfaces closed. The compressor/condenser unit is divided into a suction unit and a discharge unit corresponding to the suction area and the discharge area of the louver frame. The louver frame includes an isolating means for isolating air between the suction area and the discharge area so as to prevent air discharged from the discharge unit thought the discharge area from being re-ingested into the suction unit through the suction area of the louver frame.

30 Claims, 11 Drawing Sheets

U.S. PATENT DOCUMENTS

| | | | | | |
|---|---|---|---|---|---|
| 3,128,610 | A | * | 4/1964 | Moore | 62/263 |
| 3,308,634 | A | * | 3/1967 | Smith | 62/263 |
| 3,729,952 | A | * | 5/1973 | Macleod | 62/428 |
| 3,808,960 | A | * | 5/1974 | Van Huis | 454/316 |
| 4,544,023 | A | * | 10/1985 | Marciniak | 165/48.1 |
| 4,723,419 | A | | 2/1988 | Kessler et al. | 62/507 |
| 4,819,448 | A | * | 4/1989 | Bardo et al. | 62/304 |
| 5,117,656 | A | * | 6/1992 | Keck et al. | 62/506 |
| 5,255,969 | A | | 10/1993 | Cox et al. | 312/236 |
| 5,769,709 | A | * | 6/1998 | Kim | 454/318 |
| 6,065,296 | A | * | 5/2000 | Feger | 62/77 |
| 6,431,979 | B1 | * | 8/2002 | Asbjornson et al. | 454/233 |
| 2002/0157415 | A1 | | 10/2002 | Liu | 23/12 |

FOREIGN PATENT DOCUMENTS

| | | |
|---|---|---|
| JP | 06-101873 | 4/1994 |
| JP | 11-257708 | 9/1999 |
| KR | 1020020027863 | 4/2002 |
| KR | 10-2002-0039485 | 5/2002 |
| KR | 2002-29485 | 5/2002 |

* cited by examiner

BUILT-IN TYPE OUTDOOR UNIT FOR AIR CONDITIONER

TECHNICAL FIELD

The present invention relates to an outdoor unit for an air conditioner, and more particularly to, a built-in type outdoor unit for an air conditioner which can be divided into constitutional elements and prevent re-suction of discharged air.

BACKGROUND ART

An air conditioner implying a cooler, a heater or both of them is classified into a window type and a split type. In the case of the cooler, a split type air conditioner includes an indoor unit installed indoors for cooling a room, and an outdoor unit connected to the indoor unit through refrigerant pipe lines and installed outdoors to contact air, for performing condensation heat exchange on a refrigerant gas in a condenser by using external air as a cooling medium, and supplying the condensed refrigerants to an evaporator of the indoor unit through the refrigerant pipe lines. The indoor unit is composed of the evaporator for performing cooling heat exchange for evaporating the refrigerants and absorbing evaporation heat from internal air, and a ventilating fan for circulating internal air, and the outdoor unit is composed of a compressor for compressing the refrigerant gas and supplying the compressed gas to the condenser, the air-cooled condenser for condensing the refrigerant gas from the compressor, and a cooling fan for forcibly ventilating external air to the air-cooled condenser to cool and condense the refrigerant gas. The compressor, the air-cooled condenser and the cooling fan of the outdoor unit are installed in an outdoor unit casing composing the outer appearance. The conventional hexahedral outdoor unit casing has an air suction unit for sucking air to the air-cooled condenser at its three sides, and an air discharge unit for externally discharging air absorbing condensation heat from the refrigerant gas by the heat exchange in the air-cooled condenser on its top surface.

However, the conventional outdoor unit for the air conditioner is restricted in installation spaces due to high density and strict environment regulations of cities, and increases civil applications due to noise and heat. Especially, a common residential area such as large-scaled apartment buildings regulates the outdoor units to be installed in indoor verandas to improve the appearance and prevent noise.

In order to solve the foregoing problems, Japanese Laid-Open Patent Publication No. 6-101873 suggests an air conditioner mounted building where an indoor unit of an air conditioner is installed indoors or adjacent to a room intended to be air-conditioned, and an outdoor unit of the air conditioner is installed outdoors, wherein an opening is formed on the outer wall or roof, a louver is installed in the opening, the outdoor unit of the air conditioner is positioned in the louver, and suction/discharge of the indoor unit is performed through a gap between the louver plates.

In addition, Japanese Laid-Open Patent Publication No. 3-213928 discloses a wall built-in type outdoor unit for an air conditioner including an outdoor unit main body for the air conditioner which is built in the wall and which includes a frame having the same size and thickness as the wall, a suction hole for heat exchange air installed on the same surface as the outdoor unit main body, and a discharge hole for heat exchanged air.

FIG. 1 is a cross-sectional view illustrating a conventional louver unit. Referring to FIG. 1, the louver unit 1 is divided into a suction area 7*a* and a discharge area 7*b* on a rectangular space inner wall formed on an outer wall 2 of a residential and/or commercial building, and a plurality of louver blades 8 which are externally protruded with the same length are installed in each area.

The suction area 7*a* of the louver unit 1 contacts a suction unit 11*a* of the outdoor unit, and the discharge area 7*b* of the louver unit 1 contacts a discharge unit 11*b* of the outdoor unit. That is, air is sucked through gaps between the louver blades 8 of the suction area 7*a*, supplied to the suction unit 11*a* of the outdoor unit, heat exchanged therein, discharged from the discharge unit 11*b* of the outdoor unit, and discharged through gaps between the louver blades 8 of the discharge area 7*b* of the louver unit 1.

Here, air heated due to the heat exchange operation and discharged through the louver blades 8 at the lower end of the discharge area 7*b* of the louver unit 1 is re-sucked through the louver blades 8 at the upper end of the suction area 7*a* of the louver unit 1. The re-sucked air may decrease efficiency during the heat exchange operation of the suction unit 11*a* of the outdoor unit.

In addition, the conventional arts relate merely to technologies for inserting the outdoor unit into a space formed on the outer wall of the building. That is, it is impossible to install the outdoor unit increased in volume and weight due to high air conditioning capacity in a built-in type.

Furthermore, one casing of the outdoor unit is designed to perform suction and discharge. It is thus difficult to transport and install the outdoor unit having a large weight and volume. In order to receive services for exchanging and repairing components of the outdoor unit, the whole casing must be disassembled.

DISCLOSURE OF THE INVENTION

An object of the present invention is to provide a built-in type outdoor unit for an air conditioner with a louver frame which can efficiently perform heat exchange and discharge operations of sucked air by removing interferences between suction and discharge processes of external air, when capacity of the outdoor unit sucking air from three sides and discharging it to a top surface is converted into a front suction/discharge type.

Another object of the present invention is to provide a built-in type outdoor unit for an air conditioner which can prevent re-suction of discharged air increased in a front suction/discharge type, by using an air isolating means.

Yet another object of the present invention is to provide a realistic mounting structure of a built-in type outdoor unit for an air conditioner which can built the outdoor unit in an outer wall of a commercial and/or residential building.

Yet another object of the present invention is to provide an efficient installation structure which can install an outdoor unit increased in capacity due to high air conditioning capacity in a built-in type.

Yet another object of the present invention is to provide an economical installation structure for installing a large capacity outdoor unit in a built-in type, and services for easily transporting the outdoor unit, and examining, exchanging and repairing components of the outdoor unit, by converting capacity of the outdoor unit sucking air from three sides and discharging it to a top surface into a front suction/discharge type, and separating a suction casing from a discharge casing.

In order to achieve the above-described objects of the invention, there is provided a built-in type outdoor unit for an air conditioner, including: a louver frame being fixedly installed on a rectangular space inner wall formed on an outer wall of a building, being divided into a suction area and a discharge area, including a plurality of louver blades in each area, and sucking and discharging air through gaps between the louver blades; and an outdoor unit casing being fixedly installed to contact the louver frame, having its one surface facing the suction area and the discharge area of the louver frame opened and the other surfaces closed, and being divided into a suction unit and a discharge unit corresponding to the suction area and the discharge area of the louver frame, wherein the louver frame is composed of an isolating means for isolating air between the suction area and the discharge area to prevent air discharged from the discharge unit of the outdoor unit casing through the discharge area from being re-sucked to the suction unit of the outdoor unit casing through the suction area.

Here, the louver frame includes an external frame composing a frame, and an internal frame being fastened to the external frame and including the louver blades.

Preferably, the isolating means includes the louver blades of the louver frame aligned so that an open angle of the louver blades of the suction area can be smaller than that of the louver blades of the discharge area, the outdoor unit further includes a control means for opening the louver blades of the louver frame by each open angle, and the control means is an electronic device for opening the louver blades of the louver frame according to the operation of the outdoor unit, or a manual device for opening the louver blades of the louver frame separately from the operation of the outdoor unit.

Preferably, the isolating means includes the louver blades of the louver frame externally protruded with different lengths, the protruded lengths of the louver blades of the suction area gradually increase toward the discharge area, and the protruded lengths of the louver blades of the discharge area gradually increase toward the discharge area.

Preferably, the isolating means further includes a dividing unit for dividing the suction area from the discharge area, the dividing unit is externally protruded at a predetermined height, and the protruded dividing unit is slanted toward the suction area.

According to another aspect of the invention, a built-in type outdoor unit for an air conditioner includes: a louver frame being fixedly installed on a rectangular space inner wall formed on an outer wall of a building, being divided into a suction area and a discharge area, including a plurality of louver blades in each area, and sucking and discharging air through gaps between the louver blades; and an outdoor unit casing having its one surface facing the suction area and the discharge area of the louver frame opened and the other surfaces closed, and being divided into a suction unit and a discharge unit corresponding to the suction area and the discharge area of the louver frame.

Here, the louver frame includes an external frame composing a frame, and an internal frame being fastened to the external frame and including the louver blades.

Preferably, the louver blades of the suction area and the discharge area of the louver frame maintain predetermined open angles during the operation of the outdoor unit, and the open angle of the louver blades of the suction area is smaller than that of the louver blades of the discharge area.

Preferably, the outdoor unit further includes a control means for opening the louver blades of the louver frame by each open angle, and the control means is an electronic device for opening the louver blades of the louver frame according to the operation of the outdoor unit, or a manual device for opening the louver blades of the louver frame separately from the operation of the outdoor unit.

Preferably, the louver frame further includes a dividing unit for dividing the suction area from the discharge area to prevent air discharged from the discharge unit of the outdoor unit casing through the discharge area from being re-sucked to the suction unit of the outdoor unit casing through the suction area, the dividing unit is externally protruded at a predetermined height, and the protruded dividing unit is slanted toward the suction area.

Preferably, the louver blades of the louver frame are externally protruded with different lengths, the protruded lengths of the louver blades of the suction area gradually increase toward the dividing unit, and the protruded lengths of the louver blades of the discharge area gradually increase toward the dividing unit.

Preferably, the outdoor unit further includes a fastening member for fixing the outdoor unit casing to the louver frame, and the fastening member includes 'L' shaped brackets.

Preferably, the outdoor unit casing includes an outdoor unit suction casing having its one surface opened to the suction area of the louver frame, and sucking external air for heat exchange, and an outdoor unit discharge casing being coupled to or separated from the outdoor unit suction casing, sucking external air through the outdoor unit suction casing, having its one surface opened to the discharge area of the louver frame, and discharging heat exchanged air, and the fastening member fixes the outdoor unit suction casing and the outdoor unit discharge casing to the louver frame.

Preferably, the outdoor unit further includes a grill member for preventing invasion of animals between the louver frame and the outdoor unit casing.

Preferably, the outdoor unit further includes a plate shape vibration isolating member for absorbing vibration generated in the outdoor unit between the louver frame and the outdoor unit casing.

Preferably, the outdoor unit further includes a sealing member for preventing air leakage between the louver frame and the outdoor unit casing.

BEST MODE FOR CARRYING OUT THE INVENTION

A built-in type outdoor unit for an air conditioner in accordance with the present invention will now be described in detail with reference to the accompanying drawings.

Figure 1:
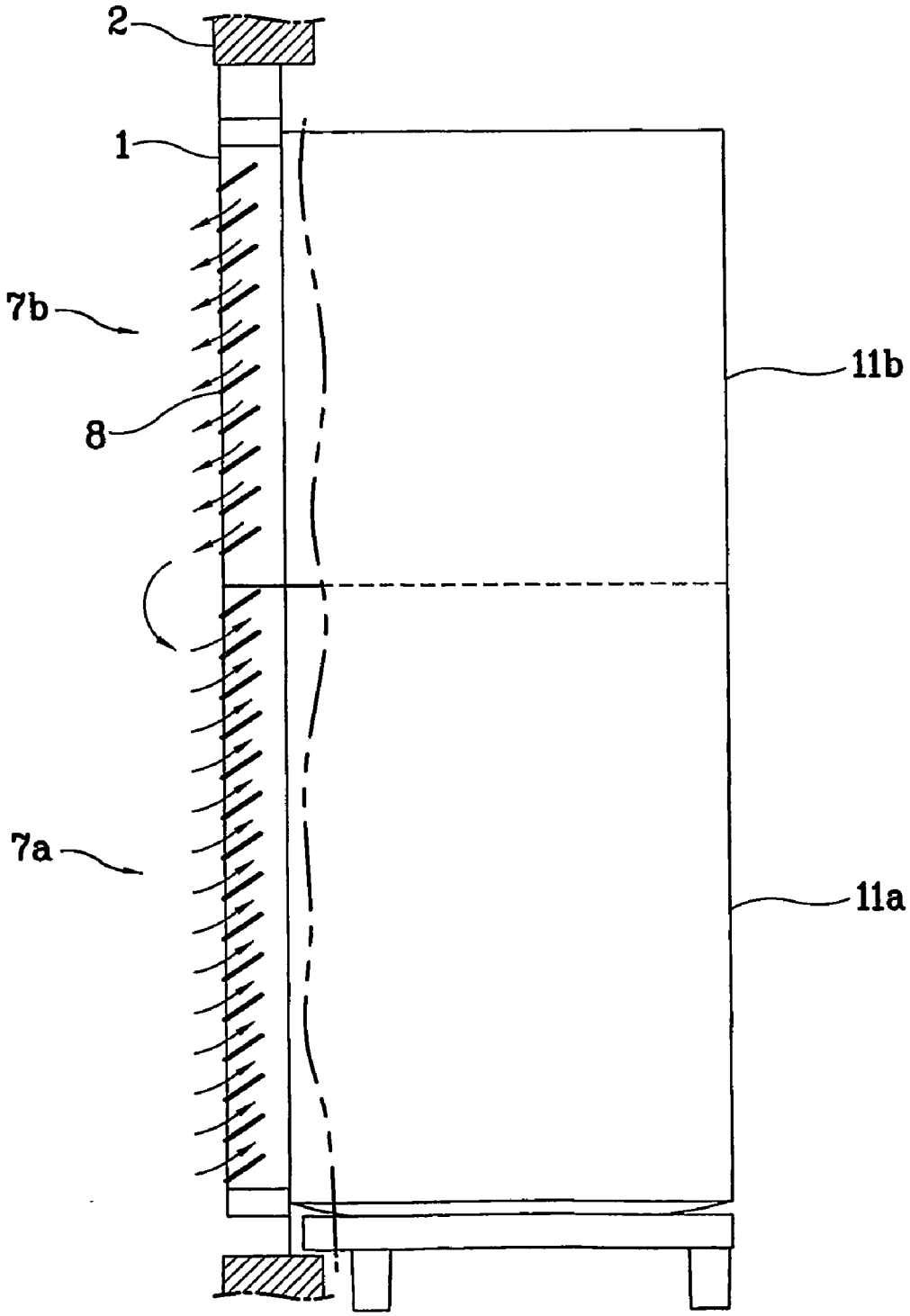
FIG. 1 is a cross-sectional view illustrating a conventional louver unit.
Figure 2:
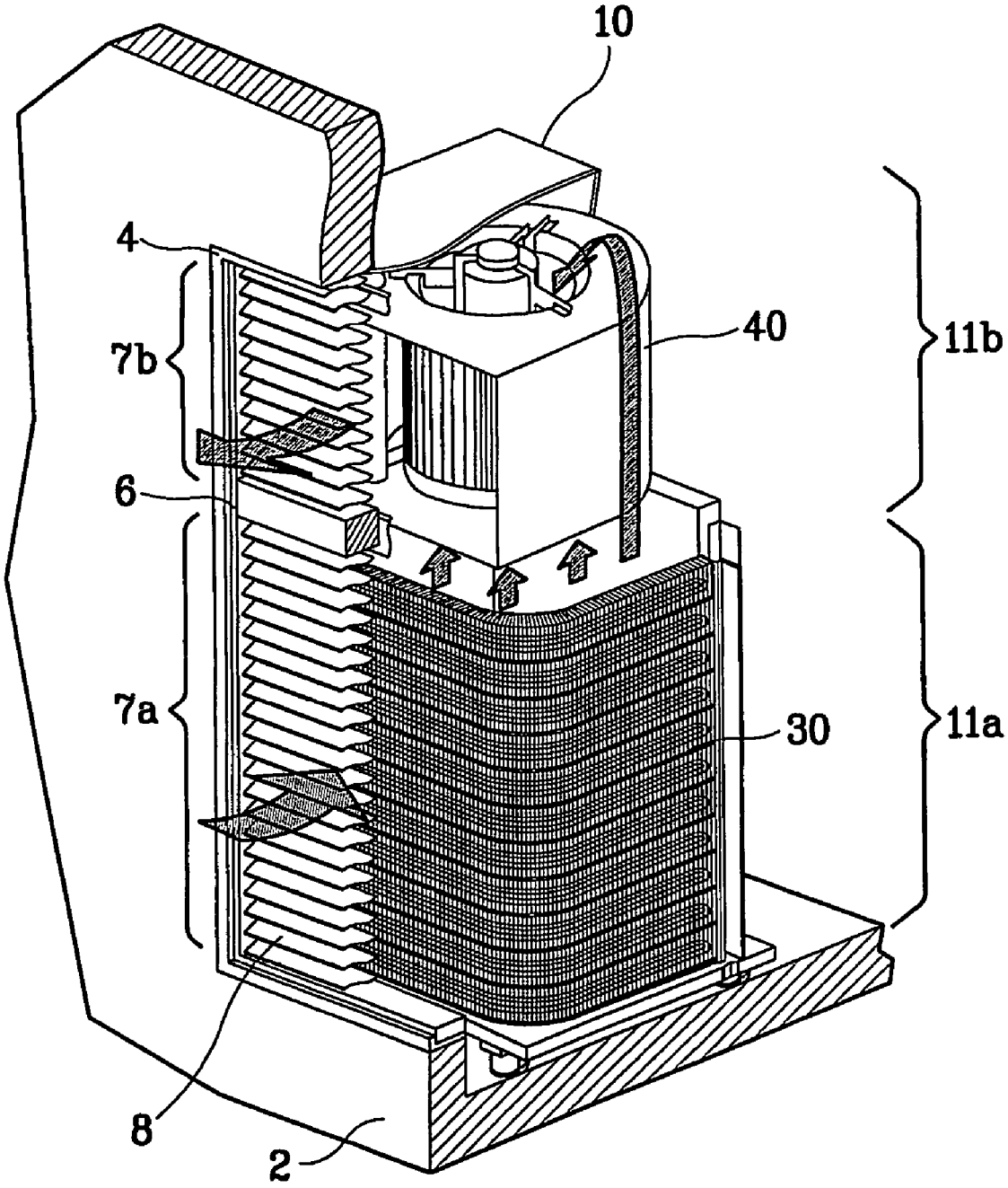
FIG. 2 is a partially-cut perspective-sectional view illustrating a built-in type outdoor unit for an air conditioner in accordance with one preferred embodiment of the present invention.
Figure 3:
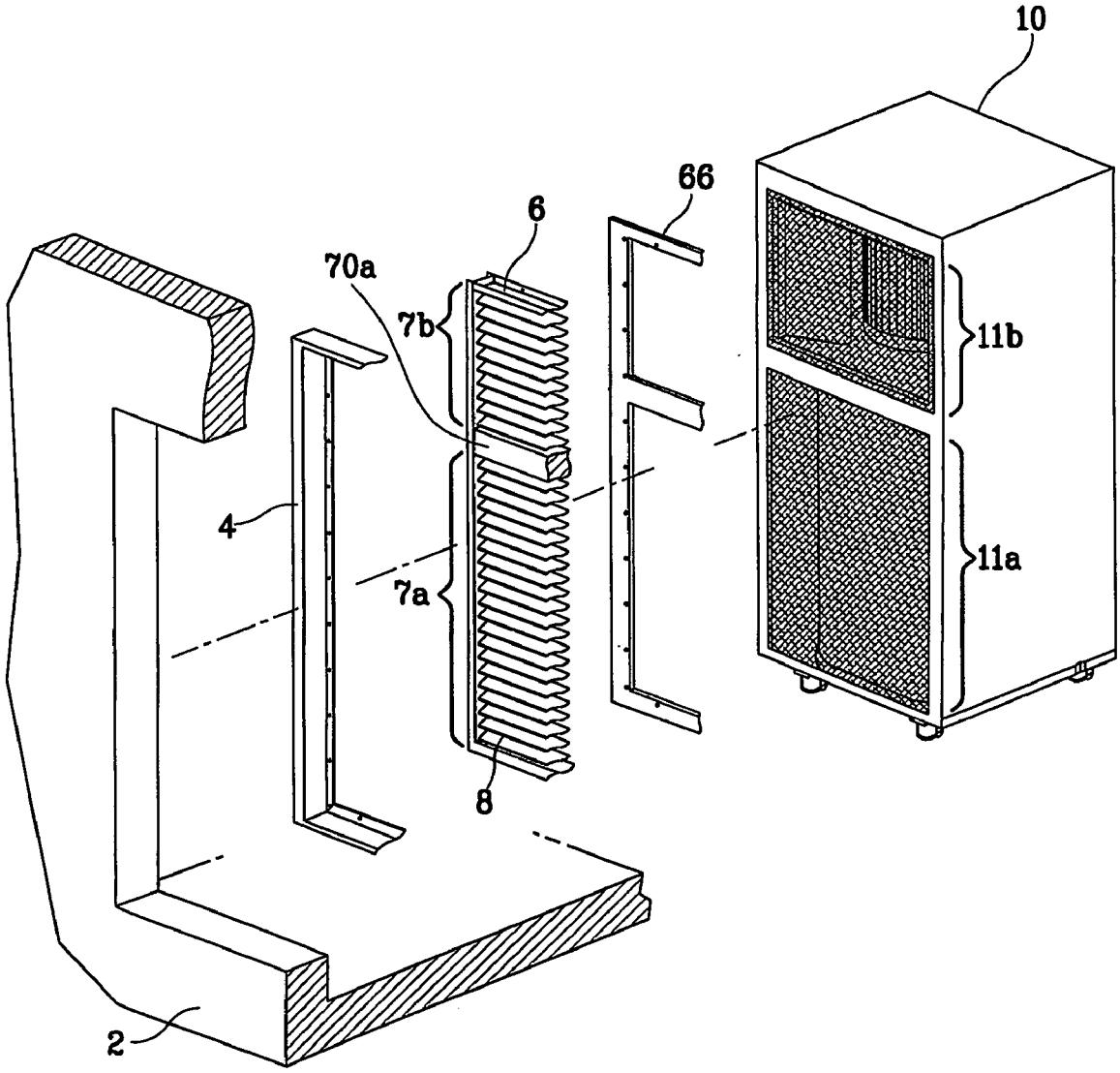
FIG. 3 is an exemplary view illustrating installation and assembly of the outdoor unit of FIG. 2.
Figure 4:
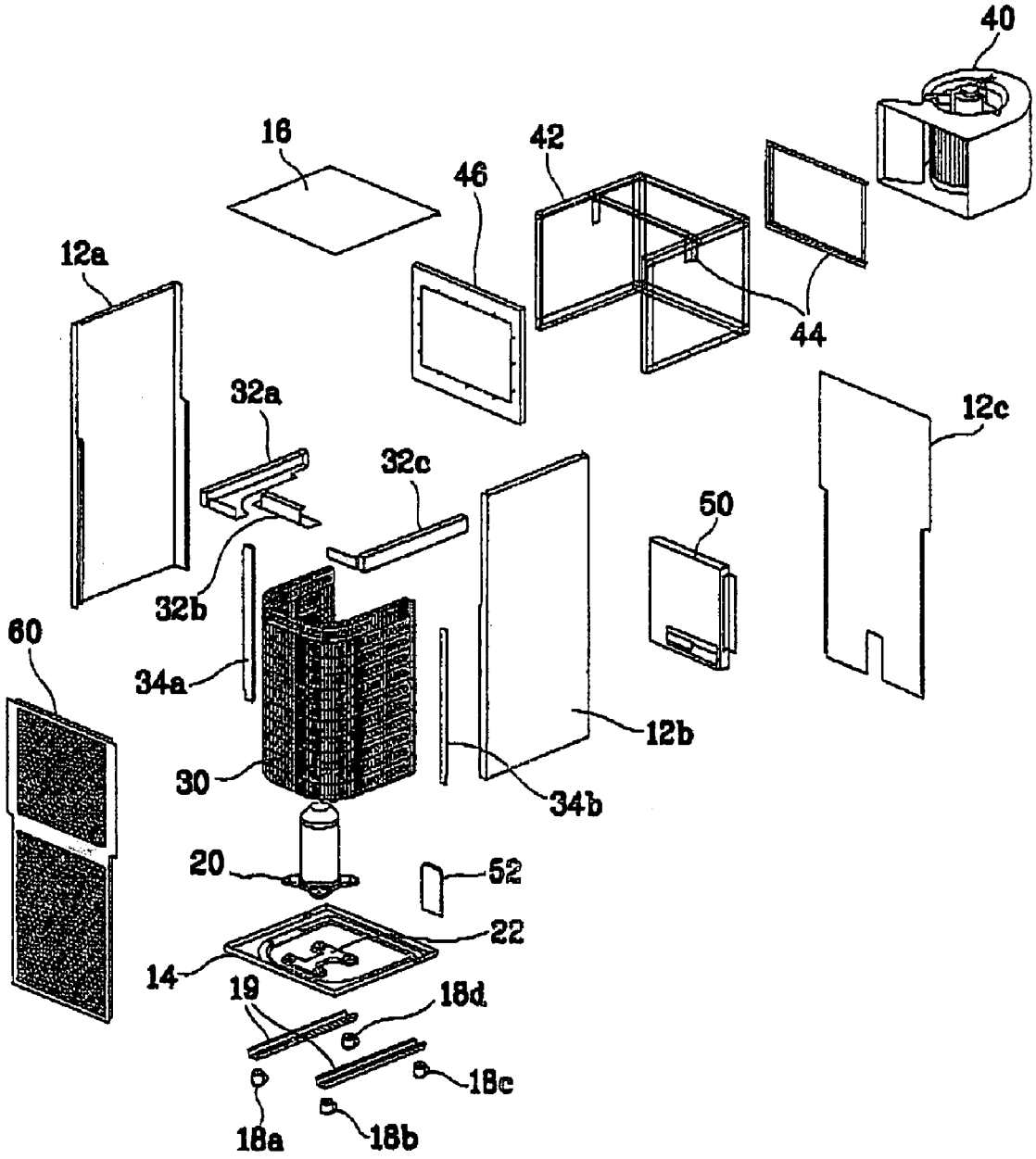
FIG. 4 is a perspective view illustrating disassembly of the outdoor unit of FIG. 2.

FIGS. 2 to 4 are structure views illustrating a built-in type outdoor unit for an air conditioner in accordance with one preferred embodiment of the present invention.

As illustrated in FIGS. 2 and 3, an external frame 4 is fixedly installed on a rectangular space inner wall formed on an outer wall 2 of a residential and/or commercial building, and an internal frame 6 is fixedly installed at the inside of the external frame 4. The internal and external frames 4 and 6 can be incorporated. An inside area of the internal frame 6 is divided into a suction area 7*a* and a discharge area 7*b*. A plurality of louver blades 8 are installed in each area, so that air can be sucked or discharged through gaps between the louver blades 8. Hereinafter, the external frame 4, the internal frame 6 and the louver blades 8 are referred to as a louver frame.

On the other hand, an outdoor unit 10 (partially shown) fixedly installed at the inside of the outer wall 2 of the building to contact the external frame 4 and/or internal frame 6 includes an outdoor unit casing. The outdoor unit casing opens its one side facing the suction area 7*a* and the discharge area 7*b* of the internal frame 6. The opened side is divided into a suction unit 11*a* and a discharge unit 11*b* to correspond to the suction area 7*a* and the discharge area 7*b* of the internal frame 6.

An air suction/discharge direction can be controlled by adjusting an open angle of the louver blades 8. In addition, an air suction direction and an air discharge direction can be distinguished by controlling the louver blades 8 of the suction area 7*a* and the discharge area 7*b* to have different open angles. A manual open device (not shown) operated by force of the user, and an automatic open device (not shown) for automatically operating the louver blades 8 according to the operation of an outdoor unit 10, namely a control command of the outdoor unit 10 performing a series of operations for cooling/heating can be used as a control means for opening the louver blades 8. The structure and constitution of the manual open device and the automatic open device for the louver blades are easily understood by ordinary people skilled in the art to which the present invention pertains.

It is also possible to determine the air suction/discharge direction in consideration of an external environment, and to open and maintain the louver blades 8 in a predetermined direction.

In addition, the louver frame includes a dividing unit 70*a* for dividing the suction area 7*a* from the discharge area 7*b*, which will later be explained in detail with reference to FIG. 5A.

On the other hand, the outdoor unit 10 fixedly installed at the inside of the outer wall 2 of the building to contact the external frame 4 and/or internal frame 6 includes an outdoor unit casing composed of components of FIG. 4. In addition, outdoor unit components of FIG. 4 are installed in the outdoor unit casing.

In the outdoor unit casing, one side facing the suction area 7*a* and the discharge area 7*b* of the internal frame 6 is opened. The opened side is divided into a suction unit 11*a* and a discharge unit 11*b* to correspond to the suction area 7*a* and the discharge area 7*b* of the internal frame 6. In addition, three side covers 12*a*, 12*b* and 12*c*, a bottom cover 14 and a top cover 16 are closed to form a rectangular parallelepiped. A plurality of leg members 18*a*, 18*b*, 18*c* and 18*d* are externally protruded from the bottom cover 14. The leg members 18*a*, 18*b*, 18*c* and 18*d* are installed on the bottom of a building, for example a veranda of an apartment building, for supporting heavy load of the outdoor unit 10. Preferably, four leg members 18*a*, 18*b*, 18*c* and 18*d* are formed in consideration of the shape of the bottom cover 14. A leg reinforcing member 19 for connecting and reinforcing the leg members 18*a*, 18*b*, 18*c* and 18*d* is formed below the bottom cover 14 in the horizontal direction. The leg members 18*a*, 18*b*, 18*c* and 18*d* further include screws (not shown) for controlling height. Accordingly, when the bottom of the building, for example the veranda of the apartment building is not flat, they can stably position the outdoor unit 10. When the two legs 18*a* and 18*b* positioned in the forward direction (toward building outer wall) among the leg members 18*a*, 18*b*, 18*c* and 18*d* further include screws (not shown), it is much easier to transport the heavy load outdoor unit 10.

In the suction unit 11*a* of the outdoor unit 10, a compressor 20 is installed on a compressor fastening unit 22, and a 'U' shaped air-cooled condenser 30 is fixedly supported on the side covers 12*a* and 12*b* and the bottom cover 14 by using condenser covers 32*a*, 32*b* and 32*c* and condenser brackets 34*a* and 34*b*. In the air-cooled condenser 30, a plurality of condenser pipe lines are formed in a zigzag shape between a plurality of condenser fins. The structure and shape of the air-cooled condenser 30 have been publicly known, and thus are not shown in detail. A refrigerant gas compressed by the compressor 20 is transmitted through the pipe lines of the condenser 30, removed its condensation heat by externally-supplied air, and condensed. In this case, the condenser covers 32*a*, 32*b* and 32*c* and the condenser brackets 34*a* and 34*b* form a wind path so as to prevent external air from being supplied to the discharge unit 11*b* not via the condenser 30. As a result, external air sucked through the gaps between the louver blades 8 of the suction area 7*a* passes through the 'U' shaped condenser 30 along the wind path of the condenser covers 32*a*, 32*b* and 32*c* and the condenser brackets 34*a* and 34*b*, and exchanges heat with the refrigerant gas flowing through the condenser pipe lines.

That is, in the discharge unit 11*b* of the outdoor unit 10, a cooling fan 40 for supplying external air to the air-cooled condenser 30 through the suction area 7*a* and discharging heat exchanged air through the discharge area 7*b* is fixedly installed on the side covers 12*a*, 12*b* and 12*c* and the top cover 16 by a cooling fan supporting member 42 and a cooling fan bracket 44. A sirocco fan is shown as one example of the cooling fan 40. Reference numeral 46 denotes a fan front installed in front of the cooling fan 40.

A control box 50 for controlling the operation of the outdoor unit 10 is installed at the inside of the side cover 12*c* composing the rear surface among the side covers, and refrigerant pipe lines which the refrigerant gas evaporated in the indoor unit is sucked through, and a valve assembly 52, a path of the refrigerant pipe lines which the refrigerants condensed in the outdoor unit 10 are discharged through are installed below the control box 50.

A mesh shaped front grill 60 is additionally installed on the front surface of the outdoor unit 10, namely one opened side facing the suction area 7*a* and the discharge area 7*b* of the internal frame 6 to prevent invasion of animals (for example, rats).

Figure 5A:
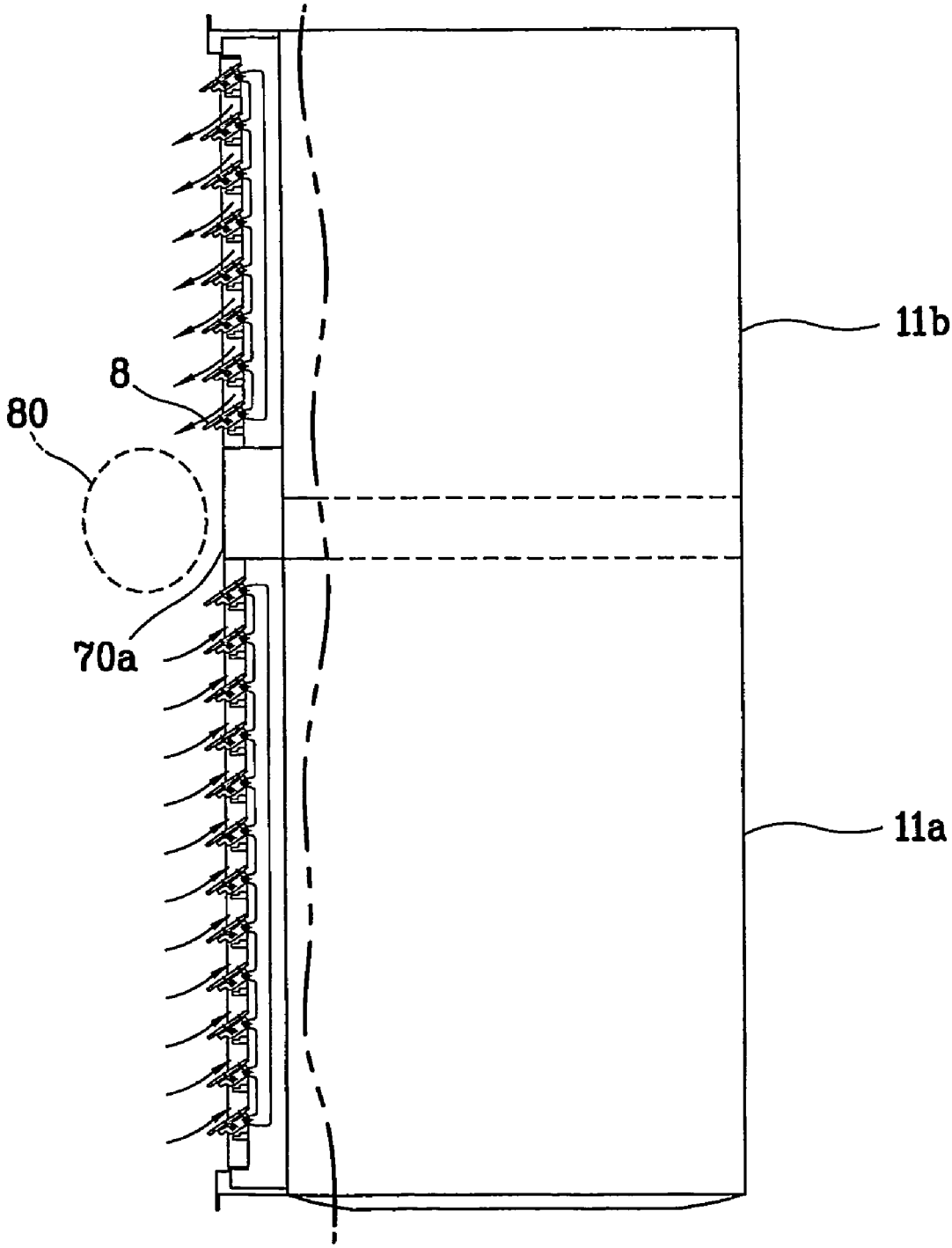
FIGS. 5A to 5C are cross-sectional views illustrating a louver frame in accordance with first to third embodiments of the present invention.
Figure 5B:
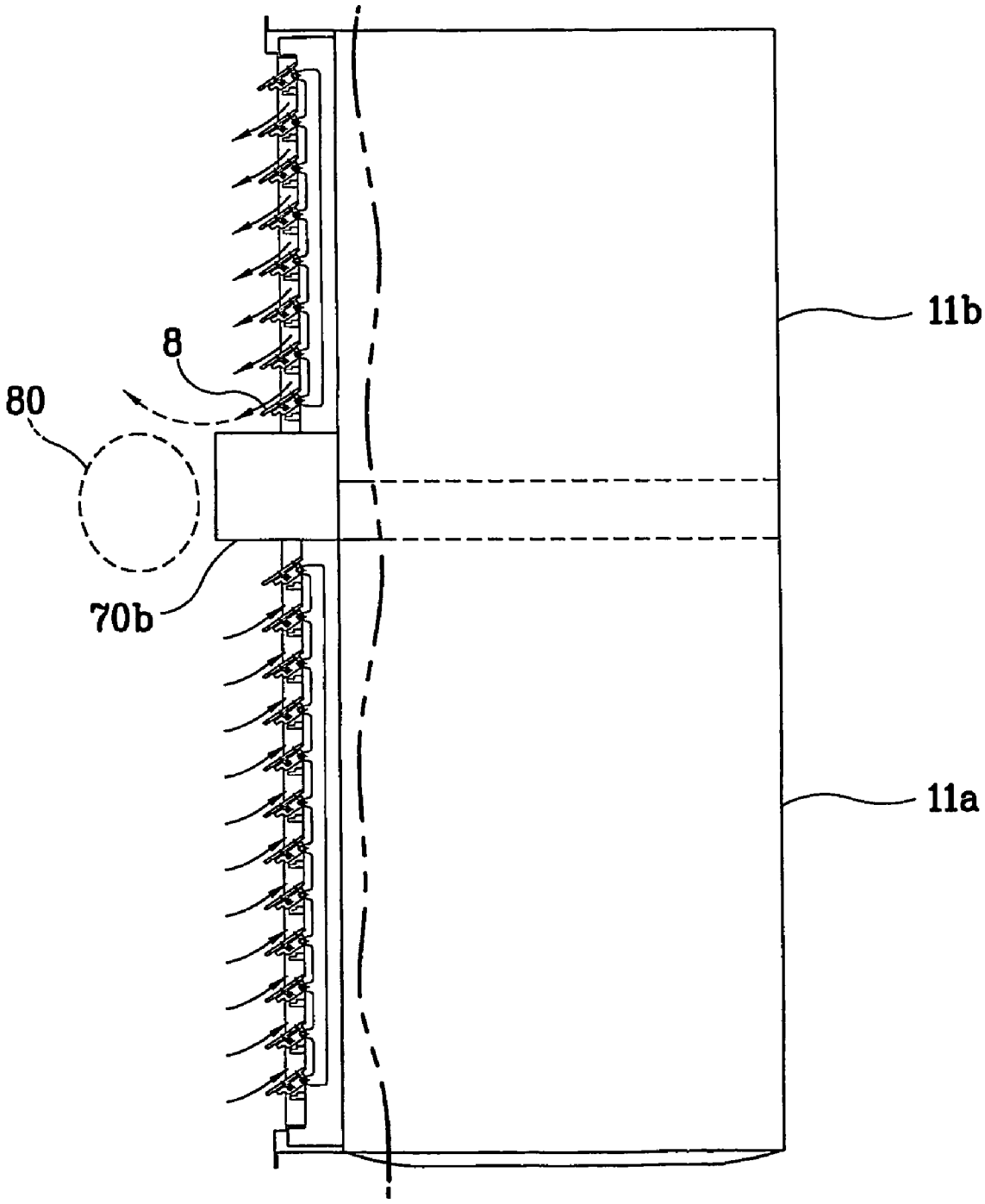
Figure 5C:
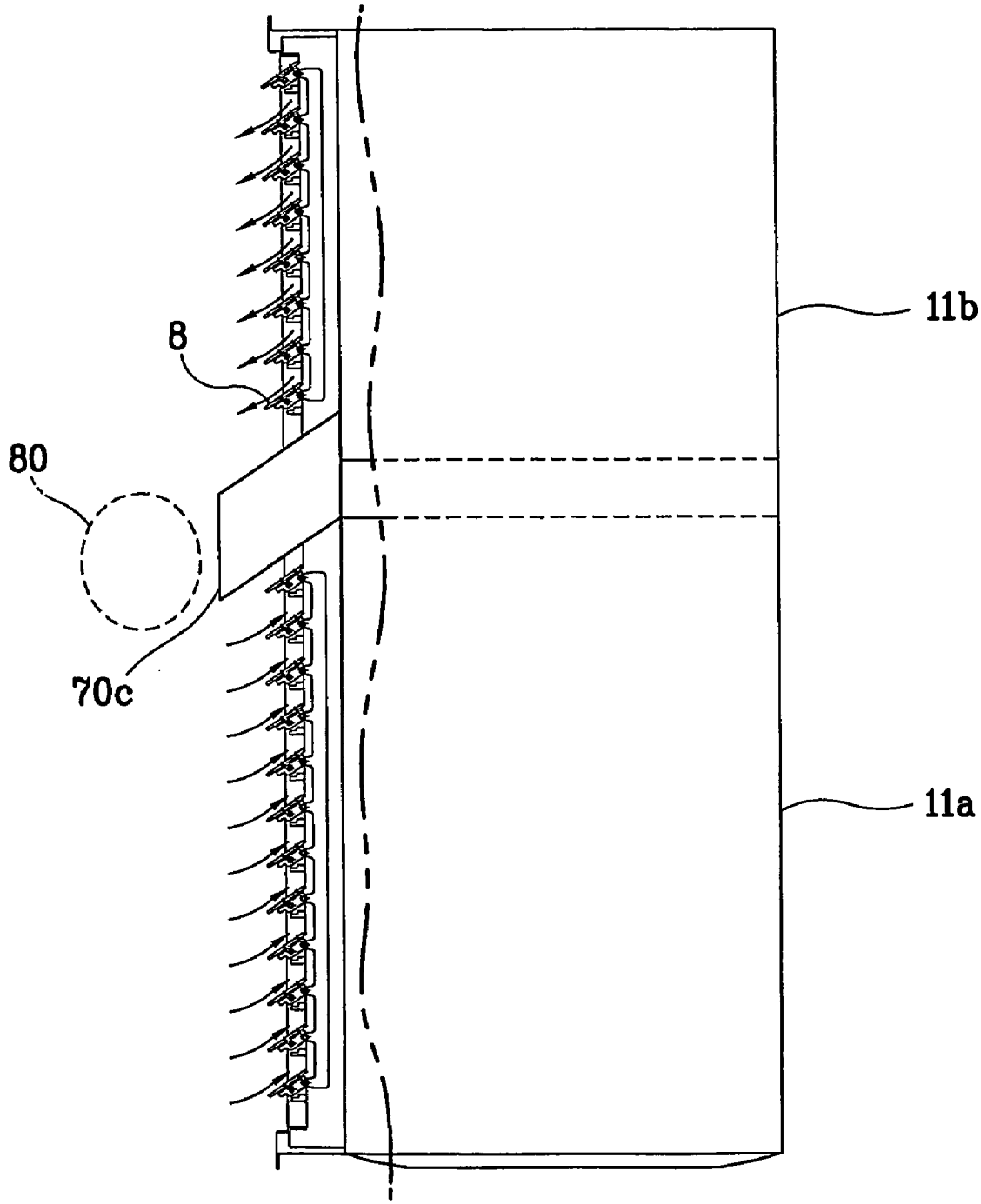

FIGS. 5A through 5C are cross-sectional views illustrating a louver frame in accordance with first to third embodiments of the present invention.

As shown in FIG. 5A, the louver frame coupled to or separated from the outdoor unit 10 includes a dividing unit 70*a* for dividing the louver blades of the suction area 7*a* from the louver blades 8 of the discharge area 7*b*.

The dividing unit 70*a* divides the suction area 7*a* of the louver frame from the discharge area 7*b* at a predetermined interval, to prevent interferences between external air sucked to the suction area 7*a* and heat exchanged air discharged from the discharge area 7*b*. Accordingly, the front suction/discharge type outdoor unit 10 rapidly sucks external air and discharges heat exchanged air. In addition, the dividing unit 70*a* prevents air discharged from the louver blades 8 at the lower end of the discharge area 7*b* from being re-sucked to the louver blades 8 at the upper end of the suction area 7*a*, namely isolates air of the suction area 7*a* from air of the discharge area 7*b*, thereby minimizing contacts of air sucked to the suction area 7*a* and heat exchanged air discharged from the discharge area 7*b*. Reference numeral 80 denotes an air isolated space formed by the dividing unit 70*a*.

As shown in FIG. 5B, as the second example of isolating air of the suction area 7*a* from air of the discharge area 7*b*, the louver frame coupled to or separated from the outdoor unit 10 includes a dividing unit 70*b* externally protruded to divide the louver blades 8 of the suction area 7*a* from the louver blades 8 of the discharge area 7*b*. The protruded dividing unit 70*b* prevents heat exchanged air discharged from the lower ends of the louver blades 8 of the discharge area 7*b* from entering the suction area 7*a*. Therefore, an air isolated space 80 is formed in front of the dividing unit 70*b*.

As illustrated in FIG. 5C, as the third example of isolating air of the suction area 7*a* from air of the discharge area 7*b*, the louver frame coupled to or separated from the outdoor unit 10 includes a dividing unit 70*c* which is externally protruded to divide the louver blades 8 of the suction area 7*a* from the louver blades 8 of the discharge area 7*b* and which has its one surface slanted. The protruded dividing unit 70*c* isolates air of the suction area 7*a* from air of the discharge area 7*b* in the same manner as the dividing units 70*a* and 70*b*. Moreover, the dividing unit 70*c* has its surface slanted to the suction area 7*a*, and thus more efficiently isolates air from the discharge area 7*b* in the upper direction. As illustrated in FIG. 5C, an air isolated space 80 is wider than the aforementioned ones. In addition, the slanted surface of the dividing unit 70*c* prevents snow or rain from being leaked to the outdoor unit 10 through the louver frame.

In order to prevent re-suction of air, the height and width of the dividing units 70*a*, 70*b* and 70*c* can be determined according to the interval between the suction area 7*a* and the discharge area 7*b*, the length of the louver blades 8 and the speed of discharged air.

Figure 6:
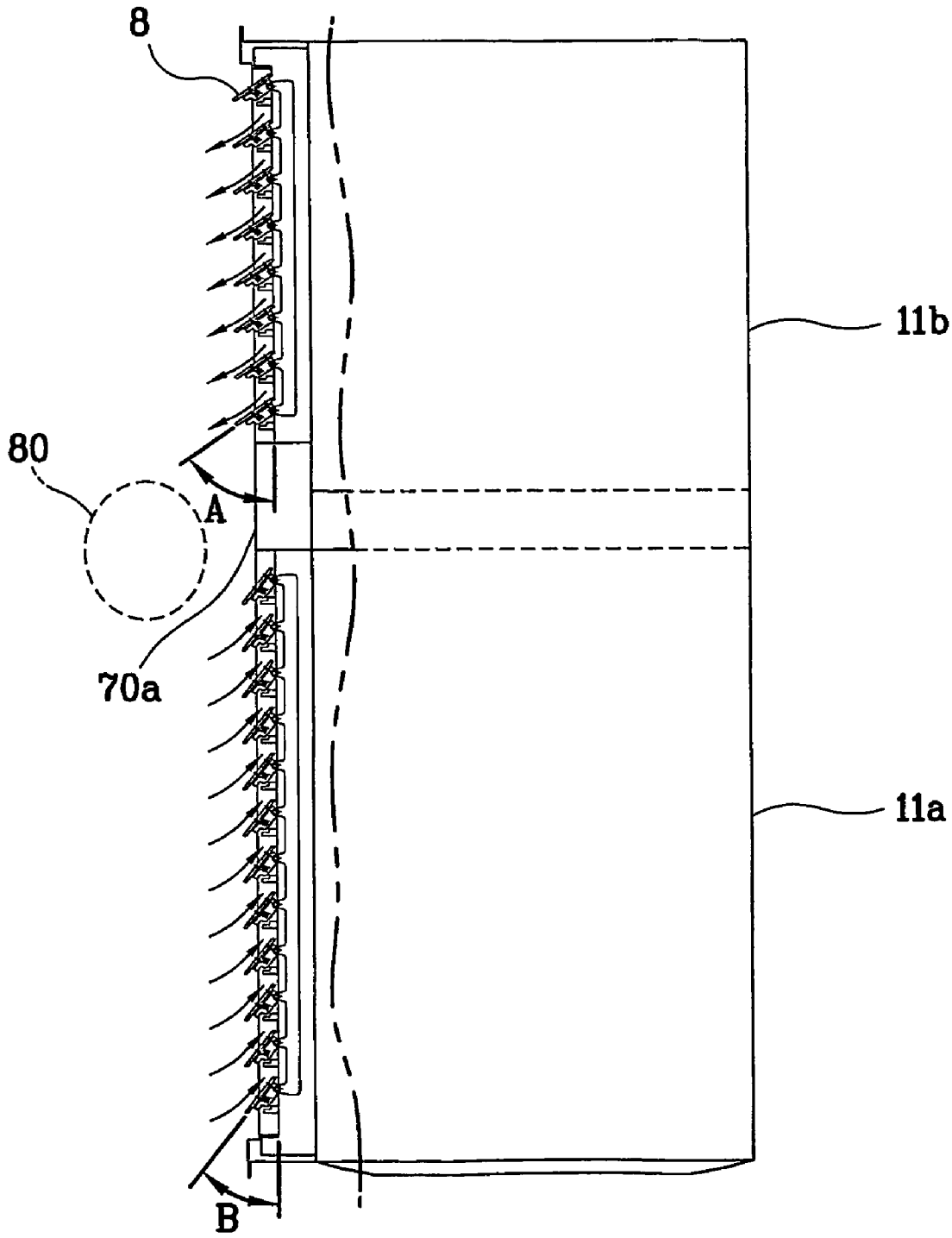
FIG. 6 is a cross-sectional view illustrating a louver frame in accordance with a fourth embodiment of the present invention.

FIG. 6 is a cross-sectional view illustrating a louver frame in accordance with a fourth embodiment of the present invention. Referring to FIG. 6, in order to isolate air of the suction area 7*a* from air of the discharge area 7*b*, the louver blades 8 of the suction area 7*a* of the louver frame have different open angles from the louver blades 8 of the discharge area 7*b*. That is, the open angle A of the louver blades 8 of the discharge area 7*b* is greater than the open angle B of the louver blades 8 of the suction area 7*a*, to prevent heat exchanged air from being discharged from the louver blades 8 of the discharge area 7*b* to the suction area 7*a*. An air isolated space 80 is formed due to the different open angles, and the open operation of the louver blades 8 can be performed by the manual or automatic device mentioned above.

Figure 7:
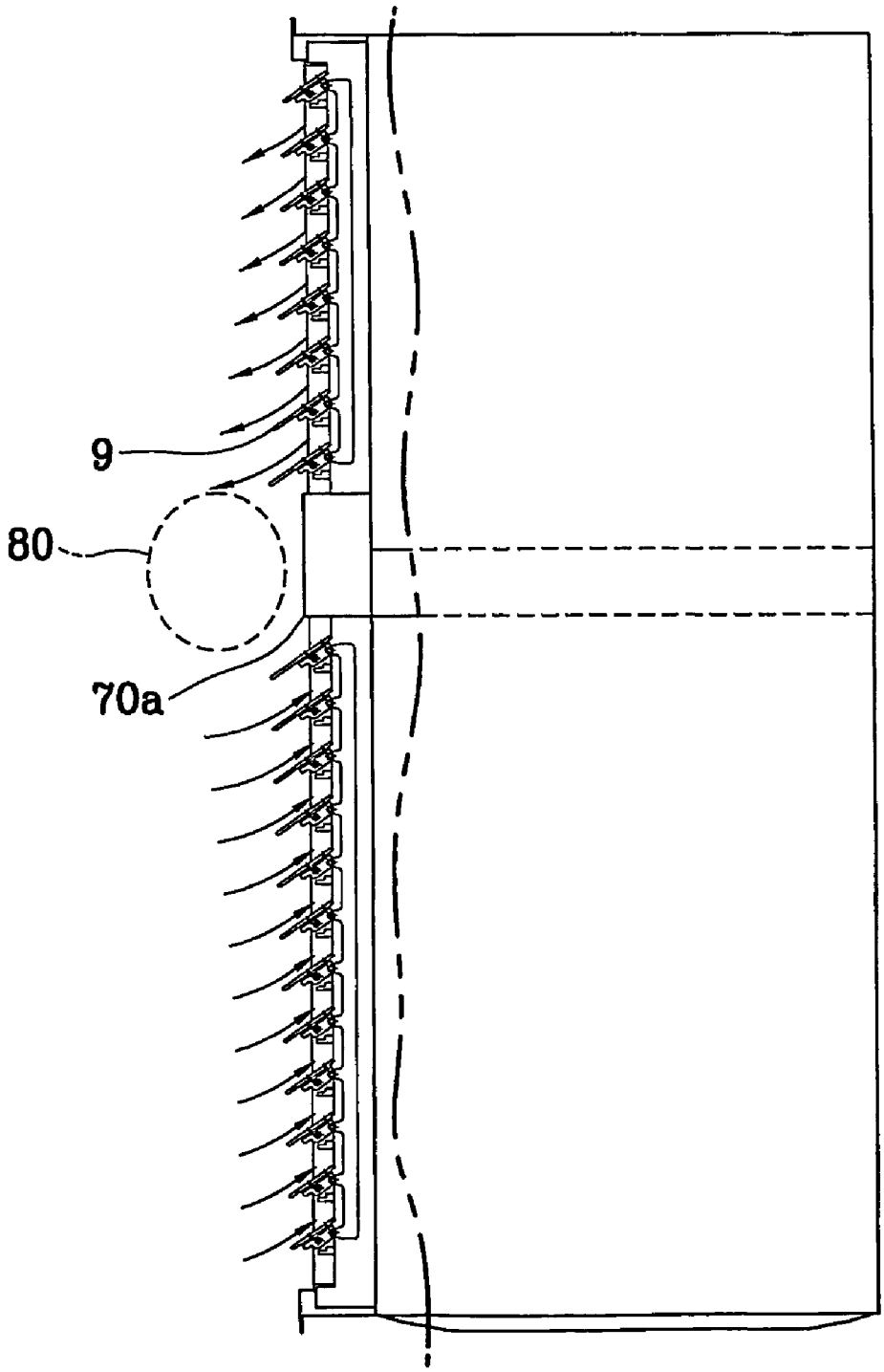
FIG. 7 is a cross-sectional view illustrating a louver frame in accordance with a fifth embodiment of the present invention.

FIG. 7 is a cross-sectional view illustrating a louver frame in accordance with a fifth embodiment of the present invention. As shown in FIG. 7, louver blades 9 of the suction area 7*a* and the discharge area 7*b* of the louver frame have different lengths. The protruded lengths of the louver blades 9 of the suction area 7*a* gradually increase toward the discharge area 7*b*, namely to the dividing unit 70*a*, and the protruded lengths of the louver blades 9 of the discharge area 7*b* gradually increase the suction area 7*a*, namely the dividing unit 70*a*.

Accordingly, air passing through the gaps between the louver blades at the lower end of the discharge area 7*b* is externally discharged farther by the louver blades 9, and thus prevented from being re-sucked through the louver blades 9 at the upper end of the suction area 7*a*. A space 80 for isolating air discharged through the louver blades 9 from the suction area 7*a* is formed to prevent re-suction of discharged air.

Figure 8:
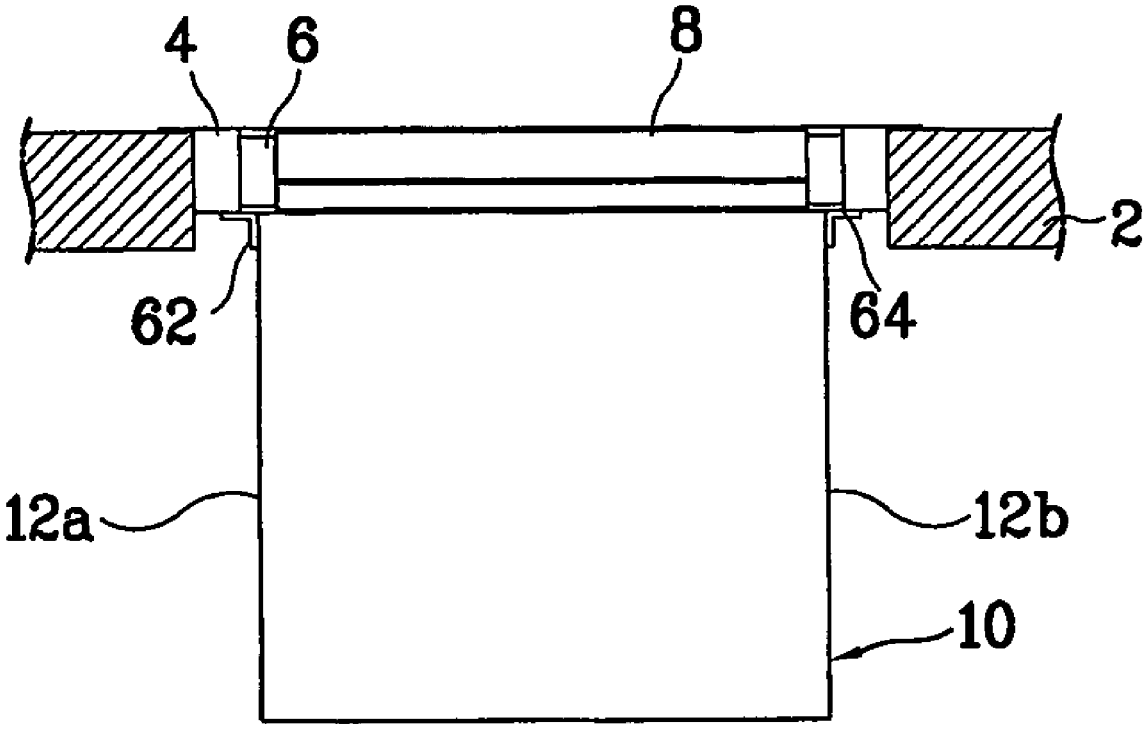
FIG. 8 is a plan view illustrating mounted constitution of the louver frame and the outdoor unit in accordance with the present invention.

FIG. 8 is a plan view illustrating mounted constitution of the louver frame and the outdoor unit in accordance with the present invention. As illustrated in FIG. 8, a width of the outdoor unit 10 is smaller than that of an internal space of the external frame 4 fixedly installed at the inside of the outer wall, and thus the outdoor unit 10 is fixed to the external frame 4 and the side covers 12*a* and 12*b* by using a special fastening member, for example 'L' shaped brackets 62. In this case, the outdoor unit 10 is not fixed to the concrete outer wall 2, and thus is easily fixedly installed. In addition, a gap exists between the concrete outer wall 2 and the outdoor unit 10 as large as the external frame 4, and thus the outdoor unit 10 is easily fixedly installed.

Moreover, a plate shape sealing member 64 is inserted between the internal frame 6 and the outdoor unit casing, so that external air sucked through the suction area 7*a* can pass through the suction unit 11*a* without being leaked to other spaces (for example, discharge unit 11*b*), and that air discharged from the discharge unit 11*b* can be externally discharged through the discharge area 7*b* without being leaked to other spaces (for example, suction unit 11*a*). A plate shape vibration isolating member 66 is inserted into the front surface of the outdoor unit casing so that the outdoor unit 10 can absorb vibration of the cooling fan (not shown).

Figure 9:
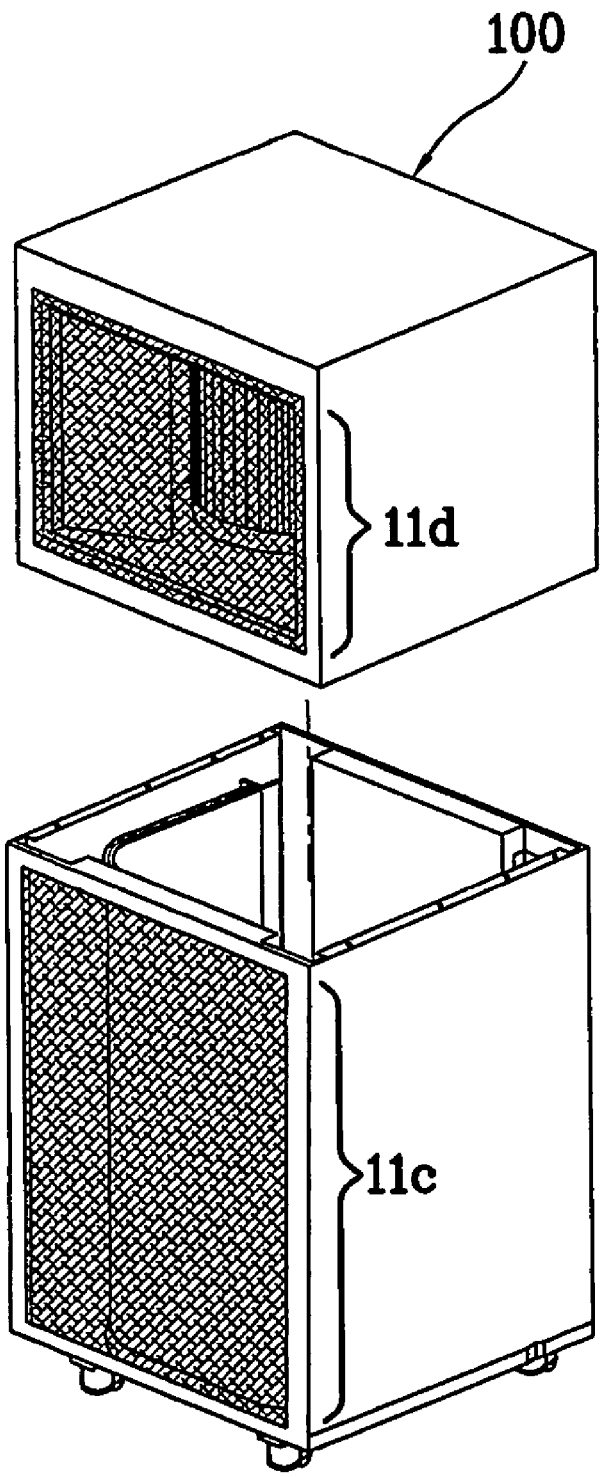
FIG. 9 is a perspective view illustrating an outdoor unit casing in accordance with another embodiment of the present invention.

FIG. 9 is a perspective view illustrating an outdoor unit casing in accordance with another embodiment of the present invention. As depicted in FIG. 9, the outdoor unit 100 includes a separable outdoor unit suction casing 11*c* and a separable outdoor unit discharge casing 11*d*. Here, the outdoor unit suction casing 11*c* and the outdoor unit discharge casing 11*d* have their one surface opened to correspond to the suction area 7*a* and the discharge area 7*b* of the louver frame, and have their another surface connected so that heat exchanged air can move through. That is, the outdoor unit suction casing 11*c* corresponds to the suction unit 11*a* of the outdoor unit 10, and the outdoor unit discharge casing 11*d* corresponds to the discharge unit 11*b* of the outdoor unit 10. The outdoor unit suction casing 11*c* and the outdoor unit discharge casing 11*d* can be coupled to or separated from each other by using a special fastening device (bolts and nuts, guide holes and hooks, etc.) (not shown).

The louver frame and the fastening member can also be applied to the separable outdoor unit 100 like the outdoor unit 10.

The outdoor unit 100 which can be assembled/disassembled reduces its whole weight and size to be easily transported and moved. The outdoor unit 100 can also be easily installed by firstly installing the outdoor unit suction casing 11*c*, and then installing the outdoor unit discharge casing 11*d*. For management and repair, the outdoor unit 100 is partially separated and disassembled so that its inside components can be examined. That is, the outdoor unit 100 has a simplified structure in time and cost.

Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A built-in type compressor/condenser unit for an air conditioner, comprising:

a louver frame configured to be fixed to an inner side wall of a space formed on an outer wall of a building, wherein the louver frame comprises a suction area, a discharge area, and a dividing unit configured to divide the suction area from the discharge area, each area including a plurality of louver blades, wherein air is sucked in and discharged through gaps formed between adjacent louver blades of the plurality of louver blades in the suction and discharge areas, respectively;

a compressor/condenser unit casing the configured to be positioned separate from and adjacent to the louver frame, wherein a surface of the compressor/condenser unit casing facing the suction area and the discharge area of the louver frame is open and the remaining surfaces are closed, and wherein the compressor/condenser unit casing comprises a suction unit corresponding to the suction area of the louver frame, a discharge unit corresponding to the discharge area of the louver frame, and a dividing member corresponding to the dividing unit of the louver frame and configured to divide open surfaces of the suction and discharge units; and a sealing member configured to be inserted between the dividing unit and the dividing member so as to prevent air leakage between the louver frame and the compressor/condenser unit casing.

2. The compressor/condenser unit of claim 1, wherein the louver frame comprises an external frame, and an internal frame fastened to the external frame which comprises the plurality of louver blades.

3. The compressor/condenser unit of claim 1, wherein the plurality of louver blades of the suction area and the discharge area of the louver frame maintain predetermined open angles during operation of the compressor/condenser unit.

4. The compressor/condenser unit of claim 3, wherein the open angle of the plurality of louver blades of the suction area is different than that of the plurality of louver blades of the discharge area.

5. The compressor/condenser unit of claim 3, further comprising a control apparatus configured to adjust an orientation of the plurality of louver blades of the louver frame.

6. The compressor/condenser unit of claim 5, wherein the control apparatus comprises an electronic device configured to adjust an orientation of the plurality of louver blades of the louver frame according to the operation of the compressor/condenser unit.

7. The compressor/condenser unit of claim 5, wherein the control means comprises a manual device configured to adjust an orientation of the louver blades of the louver frame separately from the operation of the compressor/condenser unit.

8. The compressor/condenser unit of claim 1, wherein the dividing unit protrudes externally from the louver frame at a predetermined height.

9. The compressor/condenser unit of claim 8, wherein the dividing unit is slanted toward the suction area.

10. The compressor/condenser unit of claim 1, wherein the plurality of louver blades of the louver frame protrude externally different lengths.

11. The compressor/condenser unit of claim 10, wherein the lengths of the plurality of louver blades of the suction area gradually increase toward the dividing unit, and the lengths of the plurality of louver blades of the discharge area gradually increase toward the dividing unit.

12. The compressor/condenser unit of claim 1, further comprising a fastening member configured to fix the compressor/condenser unit casing to the louver frame.

13. The compressor/condenser unit of claim 12, wherein the fastening member comprises at least one 'L' shaped bracket.

14. The compressor/condenser unit of claim 12, wherein the compressor/condenser unit casing comprises a compressor/condenser unit suction casing having a surface open to the suction area of the louver frame and configured to suck external air in for heat exchange, and a compressor/condenser unit discharge casing configured to be separably coupled to the compressor/condenser unit suction casing and configured to suck external air in through the compressor/condenser unit suction casing, wherein a surface of the compressor/condenser unit discharge casing is open to the discharge area of the louver frame so as to discharge heat exchanged air, and wherein the fastening member is configured to fasten the compressor/condenser unit suction casing and the compressor/condenser unit discharge casing to the louver frame.

15. The compressor/condenser unit of claim 1, further comprising a grill member configured to prevent entry of foreign objects between the louver frame and the compressor/condenser unit casing.

16. The compressor/condenser unit of claim 1, further comprising a vibration isolating member unit positioned between the louver frame and the compressor/condenser unit casing and configured to absorb vibration generated in the compressor/condenser unit.

17. The compressor/condenser unit of claim 4, wherein the open angle of the plurality of louver blades of the suction area is less than the open angle of the plurality of louver blades of the discharge area.

18. The compressor/condenser unit of claim 16, wherein the vibration isolating member has a plate shape.

19. The compressor/condenser unit of claim 1, wherein the compressor/condenser unit casing is configured to be positioned proximate the louver frame.

20. The compressor/condenser unit of claim 1, wherein the sealing member is configured to be inserted between a rear surface of the louver frame and a margin of the compressor/condenser unit casing facing the rear surface of the louver frame.

21. The compressor/condenser unit of claim 1, wherein a thickness of an outer peripheral surface of the louver frame is substantially equal to a thickness of a corresponding surface of the inner side wall to which it is fixed.

22. A built-in type compressor/condenser unit for an air conditioner, comprising:

a louver frame configured to be fixed to an inner side wall of a space formed on an outer wall of a building, wherein the louver frame comprises a suction area and a discharge area, each including a plurality of louver blades, wherein air is sucked in and discharged through gaps formed between adjacent louver blades of the plurality of louver blades in the suction and discharge areas, respectively, and wherein the plurality of louver blades of the louver frame protrude externally at different lengths;

a compressor/condenser unit casing provided separate from an indoor unit of the air conditioner, wherein a surface of the compressor/condenser unit casing facing the suction area and the discharge area of the louver frame open and the remaining surfaces are closed, and wherein the compressor/condenser unit casing comprises a suction unit and a discharge unit corresponding to the suction area and the discharge area of the louver frame; and a dividing unit configured to divide the suction area from the disc to prevent air discharged from the discharge unit of the compressor/condenser unit casing through the discharge area from being reingested into the suction unit of the compressor/condenser unit casing through the suction area.

23. The compressor/condenser unit of claim 22, further comprising a sealing member configured be inserted between the dividing unit and the compressor/condenser unit casing so as to prevent air sucked through the suction area of the louver frame from leaking into the discharge unit of the compressor/condenser unit casing, and to prevent air discharged from the discharge unit of the compressor/condenser unit casing from leaking into the suction unit of the compressor/condenser unit casing.

24. The compressor/condenser unit of claim 22, wherein an open angle of the plurality of louver blades of the suction are is different than an open angle of the plurality of louver blades of the discharge area of the louver frame during operation of the compressor/condenser unit.

25. The compressor/condenser unit of claim 24, wherein the open angle of the plurality of louver blades of the suction area is less than the open angle of the plurality of louver blades of the discharge area.

26. The compressor/condenser unit of claim 24, further comprising a control apparatus configured to adjust an orientation of the plurality of louver blades of the louver frame during operation of the compressor/condenser unit.

27. The compressor/condenser unit of claim 22, wherein the dividing unit protrudes externally from the louver frame and at a slant toward the suction area.

28. The compressor/condenser unit of claim 22, wherein the lengths of the plurality of louver blades of the suction area gradually increase toward the dividing unit, and the lengths of the plurality of louver blades of the discharge area gradually increase toward the dividing unit.

29. The compressor/condenser unit of claim 22, further comprising a grill member configured too prevent entry of foreign objects between the louver frame and the compressor/condenser unit casing.

30. The compressor/condenser unit of claim 22, further comprising a plate shaped vibration isolating member positioned between the louver frame and the compressor/condenser unit casing and configured to absorb vibration generated during operation of the compressor/condenser unit.

* * * * *